US006394229B1

(12) United States Patent
Hastreiter

(10) Patent No.: US 6,394,229 B1
(45) Date of Patent: May 28, 2002

(54) LADDER ATTACHMENT KIT

(76) Inventor: Russell J. Hastreiter, 5732 High St., Hamburg, NY (US) 14075

( * ) Notice: Subject to any disclaimer, the term of this patent is extended or adjusted under 35 U.S.C. 154(b) by 0 days.

(21) Appl. No.: 09/648,774

(22) Filed: Aug. 28, 2000

(51) Int. Cl.[7] ..... E04G 5/02; E06C 7/06
(52) U.S. Cl. ..... 182/107; 182/214; 248/210
(58) Field of Search ..... 182/107, 214, 182/106; 248/238, 210, 14.1, 71

(56) References Cited

U.S. PATENT DOCUMENTS

| | | | | | |
|---|---|---|---|---|---|
| 1,963,908 | A | * | 6/1934 | Manasek | 248/74.1 X |
| 2,722,360 | A | | 11/1955 | Malm | |
| 3,288,249 | A | | 11/1966 | Gibson | |
| 3,318,416 | A | | 5/1967 | Robinson | |
| 4,306,632 | A | | 12/1981 | Brown | |
| 4,339,020 | A | | 7/1982 | Wiseman | |
| 4,369,860 | A | | 1/1983 | Beane | |
| 4,502,566 | A | | 3/1985 | Wing | |
| 4,548,293 | A | * | 10/1985 | Haab | 182/106 X |
| 4,798,262 | A | * | 1/1989 | Margolies | 182/106 |
| 4,848,517 | A | * | 7/1989 | Broyles, III | 182/106 X |
| 4,949,810 | A | | 8/1990 | Dwinnell | |
| 5,165,501 | A | | 11/1992 | Donahey | |
| 5,358,071 | A | | 10/1994 | Stennett | |
| 5,373,913 | A | | 12/1994 | Santos | |
| 5,443,136 | A | | 8/1995 | Ott | |
| 6,012,546 | A | * | 1/2000 | Bee et al. | 182/107 |
| 6,152,261 | A | * | 11/2000 | Hoey | 182/107 |

* cited by examiner

*Primary Examiner*—Daniel P. Stodola
*Assistant Examiner*—Hugh B. Thompson
(74) *Attorney, Agent, or Firm*—John C. Thompson

(57) ABSTRACT

A ladder attachment kit which may be used with outside ladders (10), typically of the extension type, to facilitate access to roofs and to gutters. The ladder attachment kit includes right and left support assemblies (24), each support assembly including a suitably bent support having a first generally straight section **(26*a*), an end section (26*b*) preferably disposed at an acute angle to the first straight section, and an intermediate section (26*c*) interconnecting the first section with the end section. Each support assembly further includes a pad assembly (28) which is hinged to the end of the end section of the support so that the pad can lay upon the surface of the roof. The right and left support assemblies (24) are secured to right and left side rails (14, 16) of a ladder by suitable clamp assemblies (22)**, there being at least two clamp assemblies, and preferably more, for each support, the clamp assemblies slidably receiving the support so that they can be adjusted for roofs of differing pitches.

10 Claims, 3 Drawing Sheets

LADDER ATTACHMENT KIT

TECHNICAL FIELD

The present invention relates generally to ladder attachment kits, and more particularly to a ladder attachment kit which may be used with outside ladders, typically of the extension type, to facilitate access to roofs and to gutters.

BACKGROUND OF THE INVENTION

Ladder attachment kits are well known in the art. The following U.S. Pat. Nos. 3,288,249, 4,306,632, 4,369,860, 5,165,501 and 5,358,071 all disclose latter attachment kits which may be attached to an upper portion of an exterior ladder for preventing the ladder from leaning against and crushing a gutter. While these ladder attachment kits may be well designed for their intended purpose, none of them are concerned with providing easy access to a roof so that the user of the ladder can climb up the ladder and easily step off onto a roof. Other prior art ladder attachment kits are shown in U.S. Pat. Nos. 2,722,360, 4,339,0202, 4,502,566, and 5,373,913. These patents also do not disclose ladder attachment kits which are capable of providing easy access to the roof.

OBJECTS AND SUMMARY OF THE INVENTION

It is an object of the present invention to provide a ladder attachment kit which will allow safe direct roof access.

It is a further object of the present invention to provide a ladder attachment kit which will, in addition to providing a safe and direct roof access, also permit working on gutters without crushing the gutters as might happen when using an extension ladder without this attachment kit.

The foregoing objects and other objects and advantages of this invention are achieved by providing a ladder attachment kit which includes right and left support assemblies, each support assembly including a suitably bent support having a first generally straight section, an end section preferably disposed at an acute angle to the first straight section, and an intermediate section interconnecting the first section with the end section. Each of the supports is provided with a pad assembly which is hinged to the end of the end section so that the pad can lay upon the surface of the roof. The right and left support assemblies are secured to right and left side rails of a ladder by suitable clamp assemblies, there being at least two clamp assemblies, and preferably more, for each support, the clamp assemblies slidably receiving the right and left support assemblies so that they can be adjusted for roofs of differing pitches.

The above objects and the construction of this invention will become more apparent after a consideration of the following detailed description taken in conjunction with the accompanying drawings in which a preferred form of this invention is illustrated.

DETAILED DESCRIPTION

Figure 1:
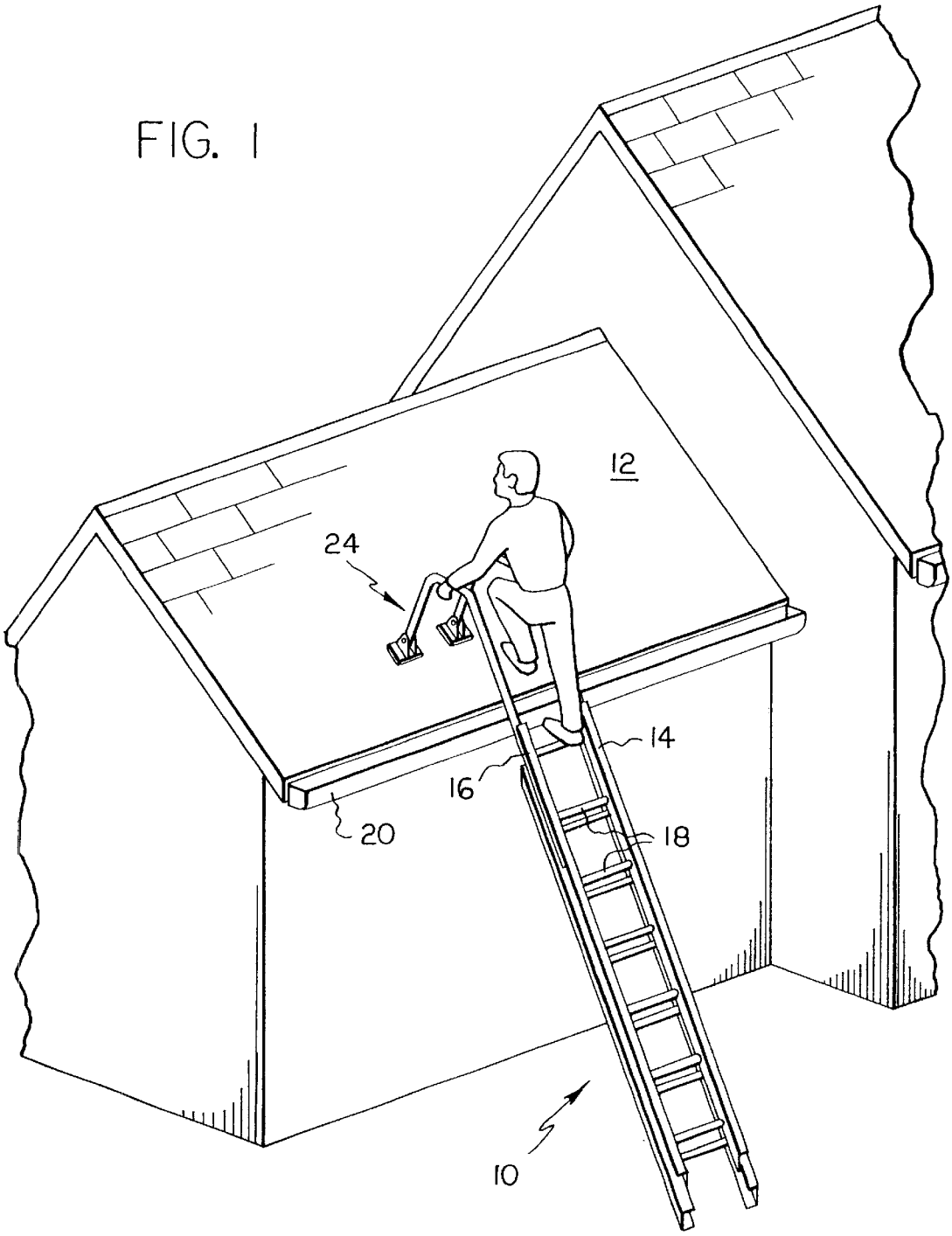
FIG. 1 is a view illustrating how the present ladder attachment kit may be employed to provide safe and direct access to a roof.

With reference to the various figures, an extension ladder is indicated generally at 10, the ladder being shown with the ladder attachment kit of this invention to provide the user with easy access to a roof 12. The extension ladder 10 is of convention construction, having sliding sections, each section having right and left side rails 14, 16, respectively. Extending between the right and left side rails are rungs 18 which may be circular in cross section, or which may have other suitable shapes. It is well know that with an extension ladder of the type illustrated it is common practice when planning to step upon the roof to extend the ladder so that, when positioned against a gutter 20, at the eave of roof, 2 or more rungs being positioned above the eave of the roof. With the ladder so positioned, the user climbs up the ladder until he is stepping upon the rung near the gutter. The user will then carefully step upon the roof. To climb down from the roof, it is then necessary to step from the roof onto the ladder. This stepping upon the roof from a ladder and back onto the ladder is somewhat awkward and somewhat dangerous. Thus, the ladder can shift from side to side at this time. Also, since the gutters are not designed for supporting ladders, the gutters may in fact yield against the weight of the ladder and user, causing unsteadiness in the upper end of the ladder. However, when using the ladder attachment kit of this invention this awkward transfer is avoided.

Figure 5:
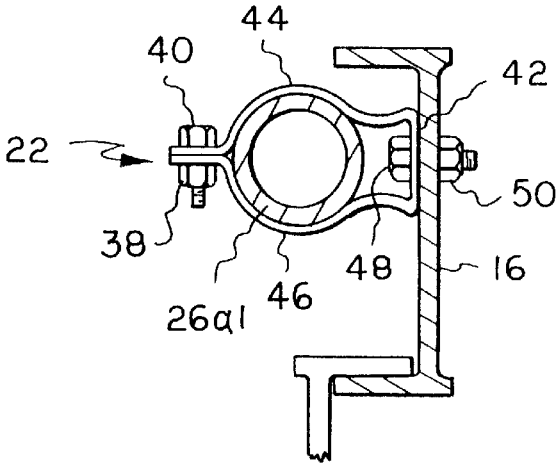
FIG. 5 is a section taken generally along the line 5—5 in FIG. 2.

The ladder attachment kit of this invention includes a plurality of clamp assemblies indicated generally at 22 in FIG. 5, and right and left support assemblies indicated generally at 24. As both the right and left support assemblies are identical, the same reference numerals for each of these support assemblies will be used throughout.

Figure 2:
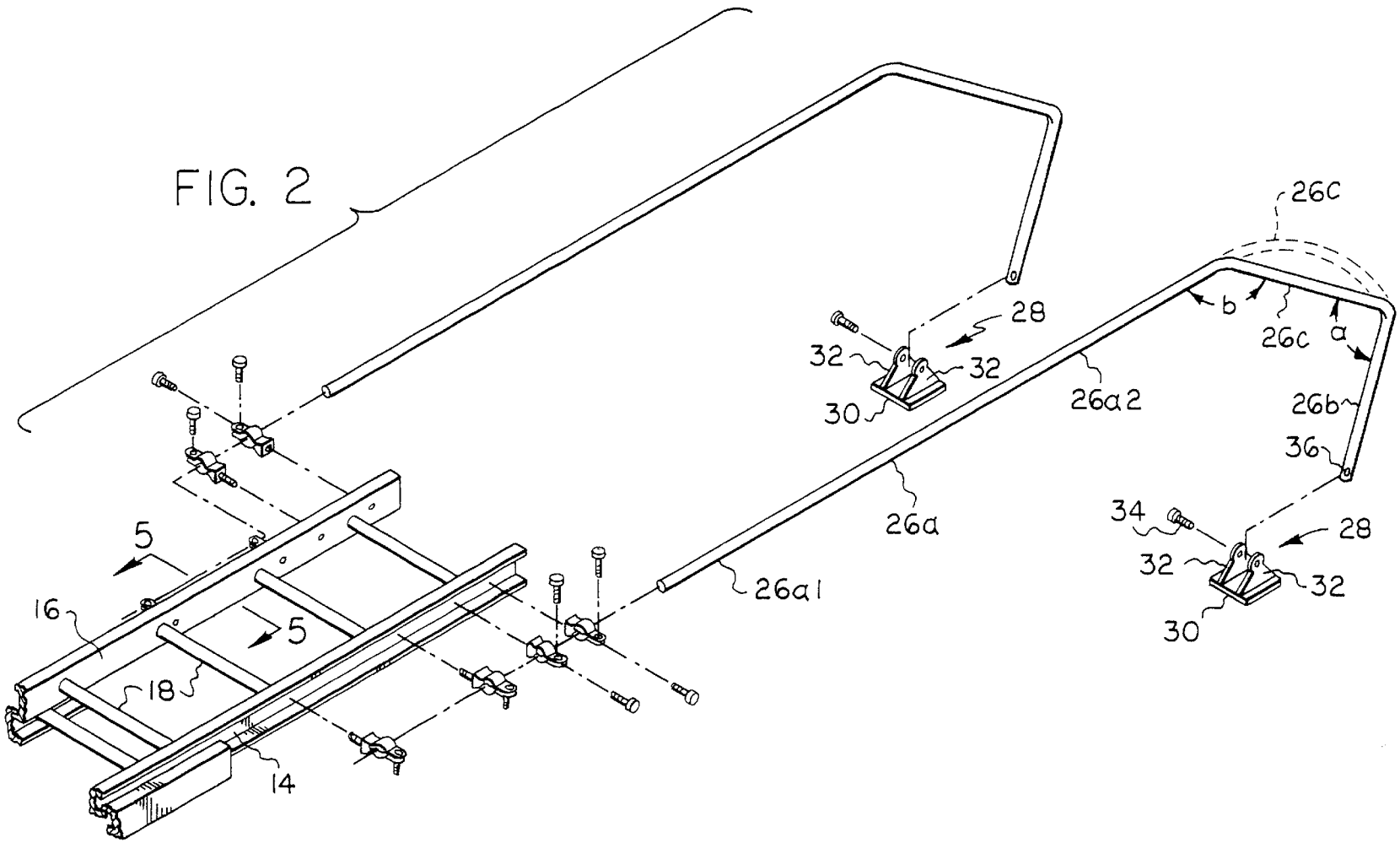
FIG. 2 is an exploded view showing the ladder attachment kit of this invention and the manner in which it is secured to right and left side rails of an extension ladder.

With reference now to FIG. 2, each of the right and left support assemblies include a support which, in the illustrated embodiment, is formed of electrical metal tubes. While metal tubes having a circular cross section are illustrated, it should be apparent that tubes of other cross sections may be employed. Alternatively, solid metal may be employed, but tubes are preferred because of their high weight to strength ratio. Each of the two electrical metal tubes is bent into three sections, there being a first generally straight section 26*a*, and end section 26*b*, and an intermediate section 26*c*. The first generally straight section 26*a* has two portions, one portion being identified at 26*a*1, and the other portion being identified at 26*a*2. The first portion is adapted to be secured to an associated side rail of the ladder 10 by a plurality of the clamp assemblies 22. While the intermediate section 26*c* is shown as a straight section in the various figures, it can be a curved section as shown in dotted lines in FIG. 2.

Figure 3:
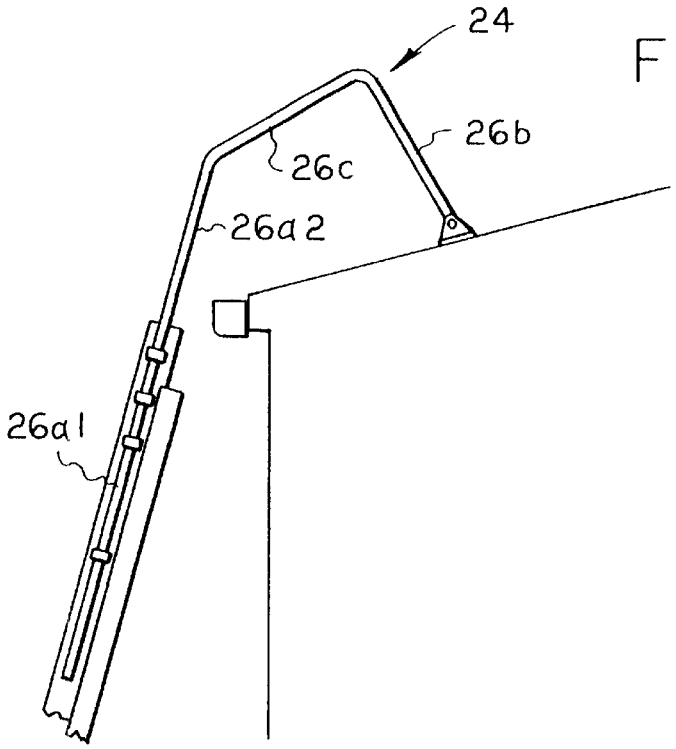
FIG. 3 is a side view of the present invention shown in FIG. 1, showing the position of the parts with a roof with a gentle slope.
Figure 4:
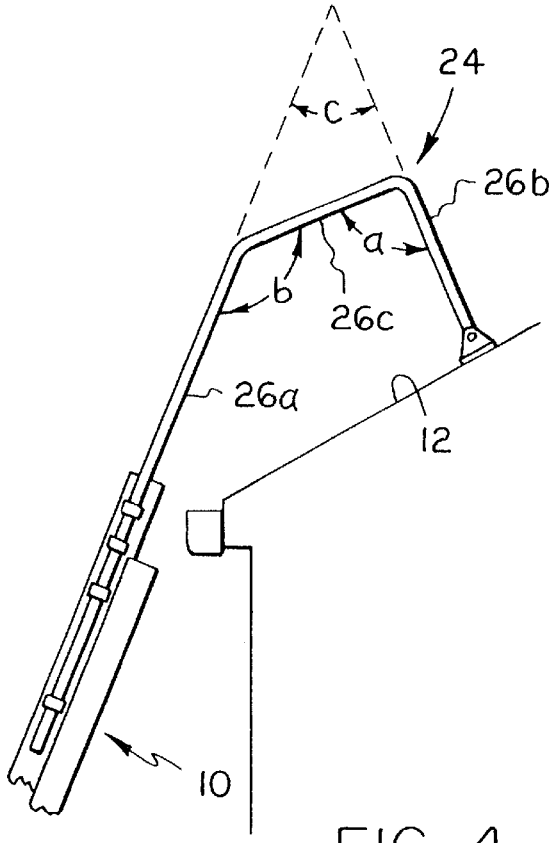
FIG. 4 is a side view similar to FIG. 3, but showing the position of the parts with a more steeply pitched roof.

In FIG. 2 the supports are shown rotated from their normal operational position shown in FIGS. 1, 3 and 4, so that the supports lie in the plane of the drawing. It can be seen from FIG. 2, as will as from FIG. 4, that the end section 26*b* is bent at an angle "a" to the intermediate section 26*c*, angle "a" being approximately equal to 90°. Similarly, the intermediate section 26*c* is bent with respect to section 26*a* at an angle "b" of approximately 135°. By having these two angles, it can be seen from FIG. 4, that the end section 26*b* is at an angle "c" 1 of approximately 45° with respect to section 26*a*.

Each of the left and right support assemblies further includes a pad 28. The pad includes a generally rectangular base portion 30. While the base is shown as a rectangle, it may also be of differing constructions, for example circular. There are a pair of spaced apart ears extending upwardly from one side of the base 30. Each of the ears is provided with an aperture, the apertures in the ears being aligned for the reception of pivot pin 34. The pivot pin 34 is adapted to pass through a suitable aperture 36 in the end of the end section 26*b* in such a manner that the pad 28 will be free to pivot with respect thereto. Various forms of pivot pins may be utilized from a simple pin provided with a suitable head on one end, which pin may provided with an aperture for the reception of a hairpin type fastener to secure it in place. Alternatively, a simple bolt may be employed, which bolt receives a lock nut at one end to hold it place. The base 30 is typically provided with a rubber-like surface (not shown) on the side opposite from the side which has the ears 32.

As can be seen from FIGS. 2–5, the support assembly is clamped to the right and left rails of the ladder. The clamp assemblies which are illustrated are commonly referred to as electrical metallic tube standoffs and consist of a clamp fastener in the form of a nut 38 and bolt 40. The clamp fastener engages end portions of a generally U-shaped clamp having a bight portion 42 and side portions 44, 46 which are suitable shaped so that they will snugly conform about the support 26*a*1. In order to secure the clamp assemblies to the right and left rails 14 or 16, the side rails are drilled and a bolt 48 is passed through an aperture in the bight portion 42 and the aperture in the side rail and is then secured in place by a nut 50.

It should be obvious from an inspection of the various figures, that when a kit of this invention is properly assembled the first portion 26*a*1 of the first section of the support will be initially loosely received within the various clamp assemblies which have been mounted on the rails. While four clamp assemblies are shown associated with each of the right and left rails, it has been found that the second clamp from the top may be eliminated. It can also be seen from an inspection of FIGS. 3 and 4, which show roofs of differing pitches, that the ladder attachment kit of this invention must be adjusted for roofs of differing pitches. Thus, a high pitch roof, as shown in FIG. 4 will have more of the support 26 extending beyond the top of the extension ladder than with a lower pitched roof. In either case, it can be seen that the ladder is not leaning against the gutter, thus crushing the gutter.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A ladder attachment kit which is capable of being assembled onto the upper end of a ladder having spaced apart right and left side rails, and which attachment kit will give a user relatively easy access to most roofs when assembled onto the ladder; the ladder attachment kit comprising the following:

at least four clamp assemblies adapted to be secured to spaced apart locations on the side rails; and right and left support assemblies, each including a support having a first generally straight section having first and second portions, the first portion being of a length sufficient so that the first portion may be safely secured to an upper end of a side rail of the ladder by at least two of said spaced apart clamp assemblies, the second portion of the first generally straight section being so dimensioned as to extend beyond the upper end of the ladder a sufficient distance to provide the user access to most roofs when the first portion is secured to a side rail, an end section disposed at an acute angle to the first section, the end section extending downwardly when the ladder is in its normal operational position, and a generally straight intermediate section interconnecting the first generally straight section with the end section, a pad, and a fastener for pivotally securing the pad to the end section of the support;

the elements being so arranged and constructed that when the kit is properly assembled onto the upper end of the ladder, the ladder may be positioned with the pads on the surface of the roof and the ladder spaced away from any gutters by a distance of about 2–3 inches.

2. The ladder attachment kit as set forth in claim 1 wherein each clamp assembly includes a clamp, and a clamp fastener for securing the clamp to a side rail of the ladder.

3. The ladder attachment kit as set forth in claim 2 wherein each clamp fastener is a threaded fastener which may be passed through a hole drilled in the associated side rail of the ladder to secure the associated clamp thereto.

4. The ladder attachment kit as set forth in claim 3 wherein each clamp has spaced apart side portions which may be brought into close contact with sides of the first portion of the first generally straight section of the support, and a bight portion which interconnects the side portions and which is secured to an associated side rail by the clamp fastener.

5. The ladder attachment kit as set forth in claim 4 wherein each clamp further includes a nut and bolt assembly for forcing the side portions together to clamp the support, but which may be loosened to permit sliding adjustment of the support within the clamp assemblies.

6. The ladder attachment kit as set forth in claim 5 wherein there are four clamps on each of said side rails, the first clamp being disposed about 4 inches from the upper end of the ladder, the second clamp being disposed about 10 inches from the upper end of the ladder, the third clamp being disposed about 16 inches from the upper end of the ladder, and the fourth clamp being disposed about 32 inches from the upper end of the ladder.

7. The ladder attachment kit as set forth in claim 5 wherein there are three clamps on each of said side rails, the first clamp being disposed about 4 inches from the upper end of the ladder, the second clamp being disposed about 16 inches from the upper end of the ladder, and the third clamp being disposed about 32 inches from the upper end of the ladder.

8. The ladder attachment kit as set forth in claim 1 wherein the end section is disposed at an angle of about 45° to the first section.

9. The ladder attachment kit as set forth in claim 1 wherein the supports are formed from electrical metallic tubes, each tube being bent into three relatively straight sections, the first section being at an angle of about 135° to the intermediate section, and the intermediate section being at an angle of about 90° to the end section so that the end section is at an angle of about 45° to the first section.

10. The ladder attachment kit as set forth in claim 1 wherein the pads have a generally rectangular portion, a pair of spaced apart ears extending away from one surface of the rectangular portion, and a rubber material on the other surface of the rectangular portion.

* * * * *